US005596822A

United States Patent [19]

Desmarais et al.

[11] Patent Number: 5,596,822

[45] Date of Patent: Jan. 28, 1997

[54] RUBBER TIRED RAILWAY PLOUGH

[75] Inventors: Lionel C. Desmarais, Calgary; Bernie A. Stene, Landsdowne, both of Canada

[73] Assignee: Ledcor Industries Limited, Mississauga, Canada

[21] Appl. No.: 301,598

[22] Filed: Sep. 7, 1994

[51] Int. Cl.[6] ..... E02F 5/10

[52] U.S. Cl. ..... 37/104; 37/105; 405/180

[58] Field of Search ..... 37/104, 105, 107; 172/40, 26, 832; 104/244.1, 139; 405/174, 175, 176, 177, 178, 179, 180, 181, 182

[56] References Cited

U.S. PATENT DOCUMENTS

| | | | |
|---|---|---|---|
| 3,702,062 | 11/1972 | Olson | 172/40 X |
| 3,851,489 | 12/1974 | Richardson | 405/178 |
| 4,102,066 | 7/1978 | Christoff . | |
| 4,103,501 | 8/1978 | Laurent | 172/40 X |
| 4,152,991 | 5/1979 | Stedman et al. | 37/104 X |
| 4,871,127 | 10/1989 | Clark | 405/174 X |
| 4,890,958 | 1/1990 | Dancer | 405/180 |

OTHER PUBLICATIONS

Trade brochure entitled "KRAC", date unknown.

Trade brochure entitled "RWF BRON Offset Pipe/Cable Plow", date unknown.

*Primary Examiner*—Terry Lee Melius
*Assistant Examiner*—Robert Pezzuto
*Attorney, Agent, or Firm*—John Russell Uren

[57] ABSTRACT

Cable laying apparatus for burying cable in or adjacent to a railway bed. A cable laying plough is mounted to a rubber tired loader and the loader moves forwardly under its own power while straddling the track. A pair of rail wheels are mounted on the forward and rearward ends of the loader. The cable laying plough is mounted to a bracket or plate spanning the track and pivotally mounted to hydraulically controlled arms extending from the loader. The plough may be attached to the bracket on either side of the track in order to reach cable burying positions located on both sides of the track.

13 Claims, 5 Drawing Sheets

RUBBER TIRED RAILWAY PLOUGH

INTRODUCTION

This invention relates to a cable laying method and apparatus and, more particularly, to a cable laying method and apparatus which utilizes a cable plough mounted to a rubber tired self-powered vehicle for laying cable in or adjacent to a railway bed.

BACKGROUND OF THE INVENTION

Frequently, utilities will lay cable in or adjacent to a railway bed. There are several advantages in doing so. First, the right of way provided by the railway can avoid time consuming efforts to obtain right of ways from property owners located along the proposed cable route. Second, such cables need not have supporting structures such as posts and the like since they are buried underground. Thirdly, damage to the cables is minimized since they are not exposed to the weather elements and are less likely to be damaged by digging, maintenance operations and the like.

Laying cables in or adjacent to a railway bed is known. Heretofore, such cable laying has been accomplished by two principal techniques. The first technique is to use a railway car such as a flatbed which is connected to a locomotive, the locomotive providing the source of power for movement of the flatbed. Two cable ploughs are mounted on the flatbed, one to lay cable on one side of the flatbed and one to lay cable on the opposite side of the flatbed, as the operator may desire. A reel holding the cable is also mounted on the flatbed and feeds the cable to a respective plough where the cable is laid under or adjacent to the railway bed.

This technique, however, suffers inherent disadvantages. First, the capital cost of the equipment utilized is unnecessarily high. Second, if a train is required to use the same tracks as the cable laying equipment during the cable laying operation, the locomotive and flatcar must find a siding where the train may pass. Such a siding may be located a good distance from the working site of the cable laying with the result that there is a non-productive transportation downtime involving all of the expensive equipment. In addition, the train itself may be delayed. Third, since the cable used is mounted on the flatbed car adjacent the cable ploughs, when the equipment reaches a position such as a highway or bridge where the cable must be manually laid, the cable laying equipment will necessarily again be non-productive while the cable is removed from the cable reel, manually positioned, and then rewound. Since the cable may be well over two miles in length, the downtime of the equipment can be lengthy and costly.

A second technique used to install cable is by mounting a cable plough in the centre of the lagging end of a crawler and providing cable to the plough from a cable reel mounted on the crawler. The crawler straddles one rail of the track and the cable plough will be operable from the centrally located position on the crawler and extend outwardly on one side of the rail to lay the cable.

This technique again offers disadvantages. First, the crawler track can cause considerable damage to the ties on which the rails are mounted. Second, there is again considerable and non-productive downtime of the equipment when it is necessary to remove and rewind the cable from the reel. Thirdly, when it is necessary to remove the crawler from its working position straddling the track due to train movement or the like, it is difficult to do so without providing a surface for the crawler track on which the crawler may turn in order to move clear of the rails. This is inefficient and unnecessarily costly.

SUMMARY OF THE INVENTION

According to one aspect of the invention, there is provided cable laying apparatus comprising a self-powered vehicle, rubber tires on said self-powered vehicle, a cable plough mounted on the lagging end of said self-powered vehicle during operative movement of said self-powered vehicle, said cable plough mounted to said self-powered vehicle at one of at least two different positions, said two positions being on opposite sides of the longitudinal axis of said self-powered vehicle.

According to a further aspect of the invention, there is provided cable laying apparatus comprising a self-powered vehicle, rubber tires on said self-powered vehicle, a cable plough mounted on the lagging end of said self-powered vehicle during operative movement of said self-powered vehicle, and rail wheels mounted to said self-powered vehicle to allow said vehicle to move along railway track.

According to a further aspect of the invention, there is provided a railcar for carrying cable to be buried in or adjacent to a railway bed comprising rail wheels, a reel for holding, releasing and rewinding said cable, a power source mounted on said railcar and a rotator for rotating said reel and rewinding or releasing said cable, said rotator being operated by said power source.

According to yet a further aspect of the invention, there is provided method of laying underground cable in or adjacent to a railway bed comprising moving a cable plough mounted on a rubber tired self-powered vehicle positioned over railway track through or adjacent to a railway bed.

BRIEF DESCRIPTION OF THE SEVERAL VIEWS OF THE DRAWINGS

Specific embodiments-of the invention will now be described, by way of example only, with the use of drawings in which.

DESCRIPTION OF SPECIFIC EMBODIMENT

Figure 1:
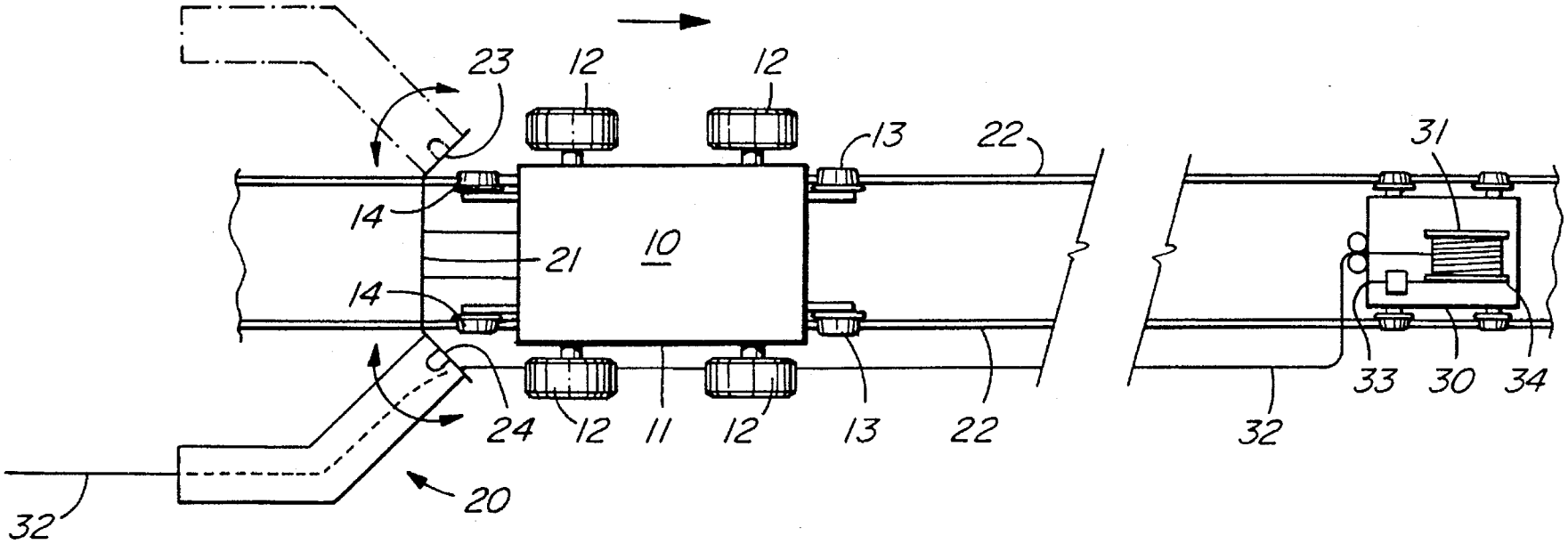
FIG. 1 is a diagrammatic plan view of the cable laying apparatus according to the invention.

Referring now to the drawings, a cable laying apparatus is generally illustrated at 10 in FIG. 1. It comprises a self-powered vehicle, conveniently a loader 11, having four (4) rubber tires 12 and four (4) forwardly and rearwardly mounted rail wheels 13, 14, respectively, the forwardly direction being that direction indicated by the arrow although it will be understood that the loader 11 will move in reverse during the cable laying operation. The forward rail wheels 13 are adjustably mounted such that they may move vertically up and down relative to the rubber tires 12 as will be described in greater detail hereafter.

A cable laying plough generally illustrated at 20 is mounted to a plough mounting plate or bracket 21. Plate 21 is, in turn, mounted to the forward end of the loader 10 although it is referred to as the lagging end of the vehicle 10 during operation as previously explained. Plate 21 is vertically adjustable relative to loader 10, as will be described in more detail hereafter. Plough mounting plate 21 extends across the tracks 22 and has angularly located end sections 23, 24 which allow the plough 20 to be mounted in one of two positions, either the position shown in solid or in phantom in FIG. 1, depending on which side of the track 22 it is intended to lay the cable.

A railcar 30 is positioned on the track 22 forwardly and separately of the cable laying apparatus 10. A cable reel 31 is mounted on the railcar 30 and the cable, which is conveniently fibre optic cable, 32 is fed from the cable reel 31 to the cable laying plough 20. A relatively small engine 35 provides motive power to the railcar 30 and power to turn the cable reel 31 through a rubber driver pulley 33 which is in contact with the outer flange 34 of the cable reel 31.

Figure 2A:
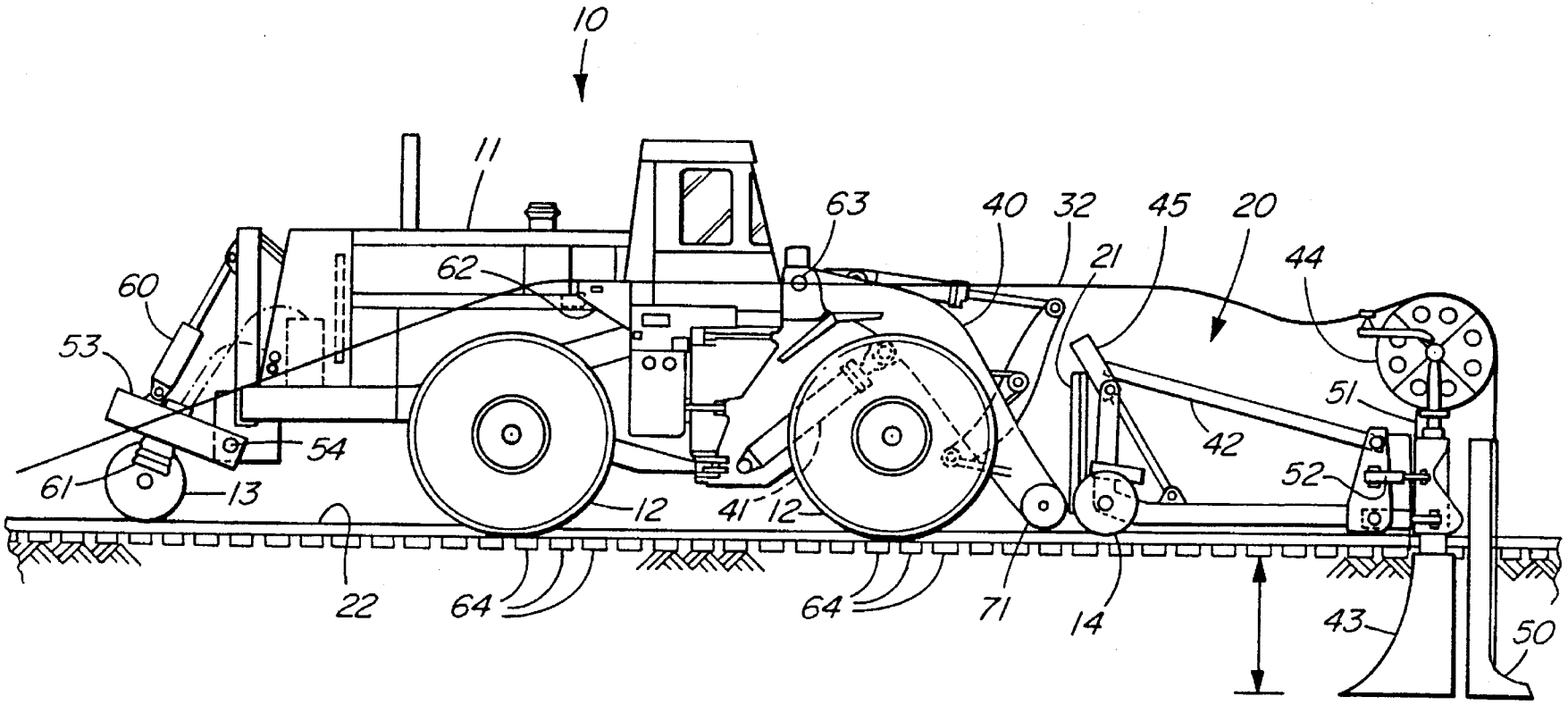
FIG. 2A is a diagrammatic side view of the self-powered vehicle with the cable plough mounted thereon.
Figure 2B:
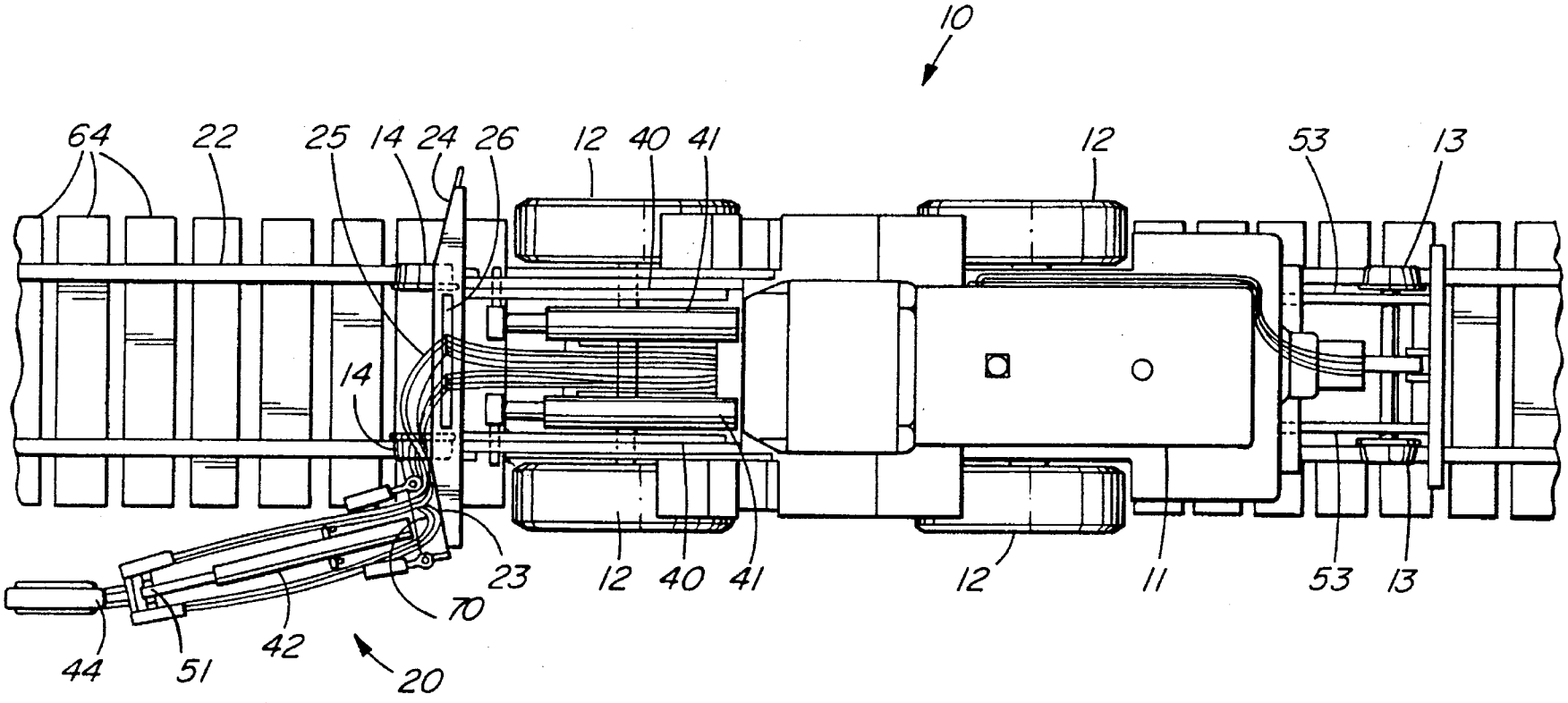
FIG. 2B is a diagrammatic plan view of the self-powered vehicle of FIG. 2A.
Figure 3A:
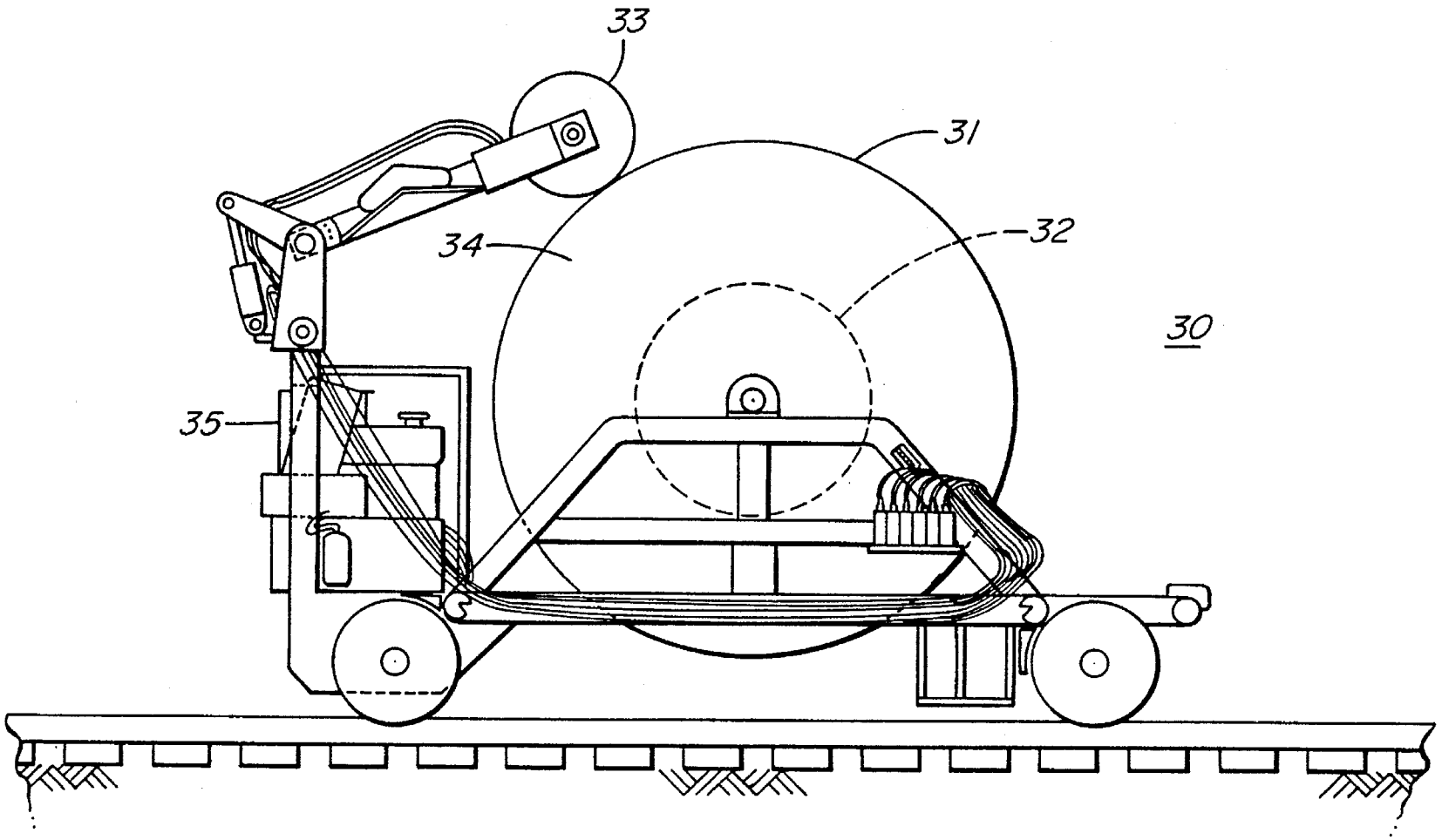
FIG. 3A is a diagrammatic side view of the cable carrying railcar according to a further aspect of the invention.
Figure 3B:
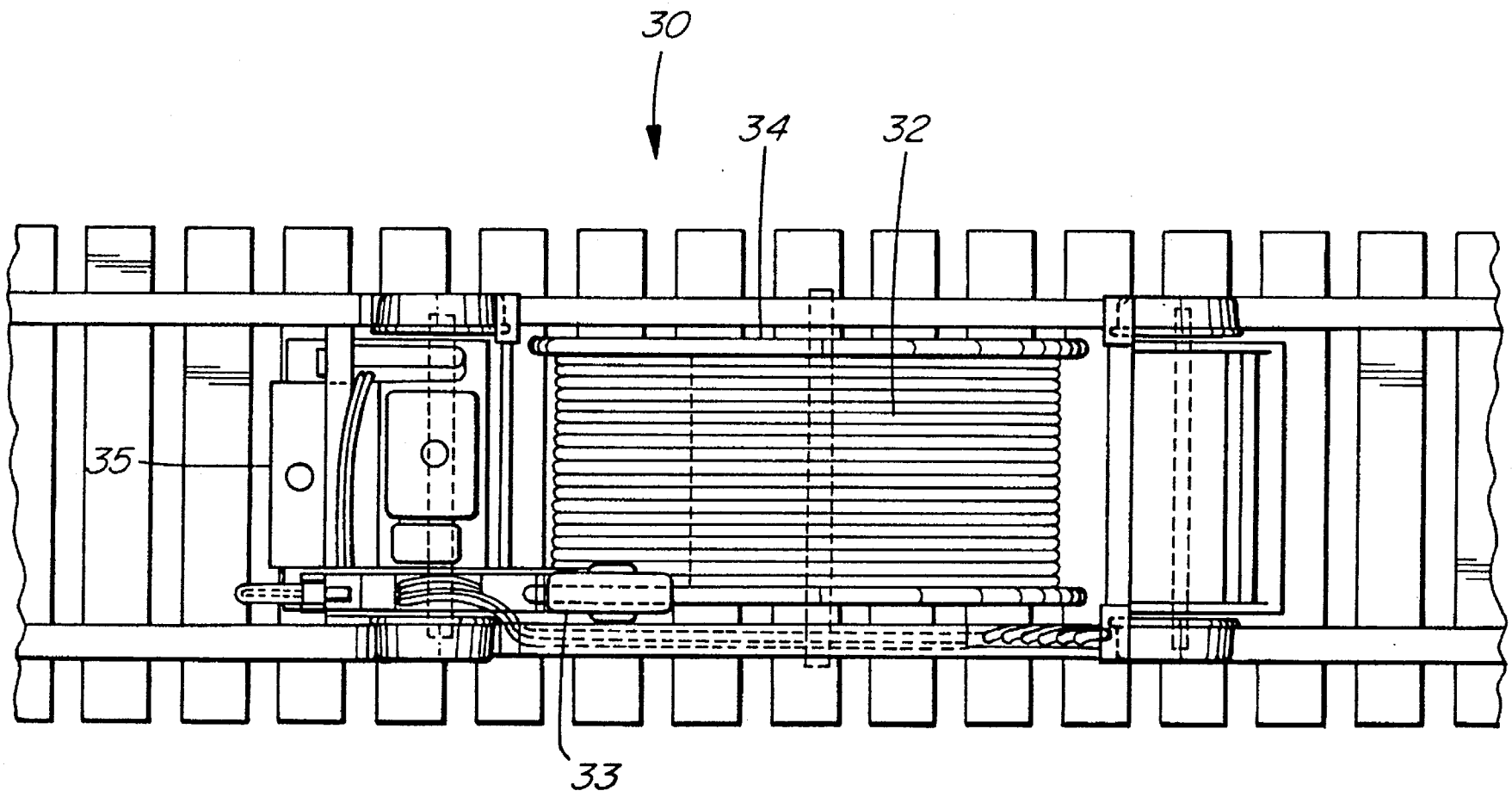
FIG. 3B is a diagrammatic plan view of the railcar of FIG. 3A.

The cable laying apparatus 10 is illustrated in greater detail in FIGS. 2 and 3. The cable laying plough 20 is mounted on the plough mounting plate or bracket 21 using a plurality of bolted connections (not illustrated). The cable laying plough 20 is typically of the type constructed by RWF/BRON and is altered in order to properly fit the bracket 21.

The bracket 21 is connected directly to the bucket arms 40 of the loader 11, the bucket (not shown) being previously removed and replaced with bracket 21. The bucket arms 40 are raised and lowered vertically by using hydraulic cylinders 41. A hydraulic cylinder 42 extends between the plate 21 and the shank 43 and is used to adjust the angular position of shank 43. Hydraulic cylinder 45 is connected between the bracket 21 and the plough shank 43 to allow the plough shank 43 to be raised or lowered relative to the bracket 21. The cable plough 20 includes a rotatable capstan 44 over which the cable 32 passes and a cable chute 50 which receives the cable 32 from the capstan 44. Shank 43 is rotatable about a vertical axis 51 by the use of hydraulic cylinders 52, the movement of the shank 43 in this case being similar to the rudder of the vertical stabilizer of an airplane.

The forward rail wheels 13 are mounted to an arm 53 which is rotatable about a horizontal axis 54 by hydraulic cylinder 60. A pneumatic cushion 61 is also provided for each forward rail wheel 13. The pneumatic cushion 61 allows a constant amount of force to be exerted by the rail wheel 13 on the track 22. It will be appreciated that there are two forwardly located rail wheels 13, one for each rail 22, each having its own pneumatic cushion 61 although the single hydraulic cylinder 60 moves both of the rail wheels 13.

Rail wheels 14 are mounted to the cable laying plough 20 and are movable therewith. That is, as the bucket arms 40 are raised and lowered, the rearwardly mounted rail wheels 14 are also raised and lowered.

Cable guides 62, 63 may be mounted on the loader 11 to allow the cable to run therethrough to the cable laying plough 21 and, specifically, to the capstan 44 and cable chute 50.

OPERATION

In operation, the cable 32 will initially be unwound from the cable reel 31 and will then be laid alongside the track 22 as illustrated in FIG. 1. It will pass to the cable laying apparatus 10 and specifically, will pass through cable guides 62, 63, thence to capstan 44, and cable chute 50. A hole (not shown) will initially be dug and a cable retaining device (not shown) will be placed in the hole to retain the end of cable 32. The loader 10, meanwhile, will be positioned straddling the tracks 22 and the forwardly and rearwardly located rail wheels 13 will be vertically adjusted until the rubber tires 12 of the loader 11 exert a pressure on the ties 64 that is sufficient to propel the loader 11 in the forward direction while the cable laying plough 20 is burying the cable 32 while avoiding any unnecessarily large force which may tend to damage the ties 64.

When the rearwardly located rail wheels 14 are in position on the track 22, the cable plough 20 will be lowered to the position illustrated in FIG. 2 by utilizing hydraulic cylinder 45. Movement of the loader 11 will then commence. The cable 32 will be continuously fed through the cable chute 50 and will be buried as the shank 43 creates a furrow within which the cable 32 is positioned.

The railcar 30 may be located substantially forwardly of the cable laying loader 11 such that when a bridge or road is reached where the cable 32 cannot be buried by the loader 11 and must be manually positioned, the railcar 30 can stop and the cable reel 31 can be unwound until the opposite end of cable 32 is reached. This end of cable 32 is then manually or otherwise guided past the obstruction and the cable 32 is then rewound on the cable reel 31. However, during this period of time, the loader 11 can continue operating in a productive manner to lay the cable 32. When the loader 11 reaches the obstruction, the plough 20 is raised and the loader 11 proceeds by the obstruction. It again recommences to bury the cable 32 when it reaches the opposite side of the obstruction.

If it is desired to increase or decrease the traction force provided by the rubber tires 12, the rail wheels 13 are vertically adjusted in two ways. First, hydraulic cylinder 60 may raise or lower the wheels 13. Second, the pressure in pneumatic cushion 61 can be adjusted so that the pressure provided allows the height of the loader 11 to remain at the appropriate position.

The cable laying plough 20 is shown in FIG. 1 as extending from the rightward side of plate or bracket 21. In this position, the cable laying plough 20 can rotate about a vertical axis 70 as desired by the operator. In the event, however, it is desired to bury the cable 32 on the opposite side of the track 22 adjacent or in the railbed, the cable laying plough 20 is unbolted from end section 24 and is reattached at end section 23. In this way, complete coverage of the possible cable burying positions is covered with the use of a single plough 20. Quick connect hydraulic lines 25 are conveniently used and extend from the cable laying plough 20 to a valve block 26 mounted on the loader 11.

As seen in FIG. 3, a single hard vulcanized rubber wheel 71 is mounted between the loader 11 and the rail 22 on the side of the loader 11 where the cable laying operation is being conducted. This rail wheel 71 is brought into contact with the rail 22 with a force that is intended to absorb and lessen any impact loading which would otherwise be transmitted from the plough 20 to the loader 11 and, thence, to the rails 22 through rail wheel 14. It is also intended to provide additional stability to the loder 11 during the cable laying operation. The wheels 71 are mounted on bucket arms 40 and are adjusted by retracting or extending hydraulic cylinders 41.

When it is necessary to remove the cable laying apparatus 10 from the track 22 because a train is approaching or the cable burying operation is completed, hydraulic cylinders 41, 45 are appropriately extended or rotated to remove the plough shank 43 from the ground and to raise the rearward rail wheels 14 and rubber wheels 71 from the rails 22. Likewise, hydraulic cylinder 60 is operated to rotate the forwardly located rail wheels 13 about axis 54 so as to leave contact with the rails 22. The loader 11 will then be free of contact with the rails 22 and will be in contact with the ground solely through its rubber tires 12. The loader 11 may then easily be driven off the track 22.

In the event the burying operation is conducted in exceptionally difficult conditions and additional tractive force is required to move loader 11, a second loader (not illustrated) may be connected to the forward end of loader 11 by a chain or cable. The second loader can be a standard unmodified loader such as a bucket loader or the like.

While specific embodiments of the invention have been described, such embodiments are illustrative of the invention only and not as limiting its scope, which scope should be defined in accordance with the accompanying claims.

What is claimed is:

1. Cable laying apparatus for laying cable comprising a self-powered vehicle, said self powered vehicle having a leading end and a lagging end, rubber tires on said self-powered vehicle, rail wheels mounted to said self-powered vehicle and being operable to allow said vehicle to move along a railway track, a cable plough mounted on said lagging end of said self-powered vehicle during operative movement of said self-powered vehicle, said cable plough being mounted to said self-powered vehicle so as to engage ground outside said railway track in one of two different positions, each of said positions being on opposite sides of the longitudinal axis of said self-powered vehicle and outside railway track, said cable plough being operable to lay said cable outside said railway track and in said ground.

2. Cable laying apparatus as in claim 1 and further comprising an adjuster connected to said self-powered vehicle, said adjuster being operable to provide height adjustment to at least a pair of said rail wheels relative to said rubber tires.

3. Cable laying apparatus as in claim 1 and further comprising a railcar for carrying cable to be buried by said plough, rail wheels on said railcar, a cable reel for holding, releasing and rewinding said cable and a power source for rotating said cable reel, said railcar being separate from said self-powered vehicle and being movable relative thereto.

4. Cable laying apparatus comprising a self-powered vehicle, said self-powered vehicle having a longitudinal axis, a leading end and a lagging end, rubber tires on said self-powered vehicle, a cable plough mounted on said lagging end of said self-powered vehicle during operative movement of said self-powered vehicle, and rail wheels mounted to said self-powered vehicle to allow said vehicle to move along railway track, said cable plough on said self-powered vehicle having a shank for engaging ground, said shank being offset from said longitudinal axis of said self-powered vehicle, said shank being operably positioned outside said railway track for engaging said ground outside said railway track during operative movement of said self-powered vehicle.

5. Cable laying apparatus as in claim 4 wherein said rail wheels are height adjustable relative to said rubber tires.

6. Cable laying apparatus as in claim 5 wherein said cable plough is mounted to said self-powered vehicle at one of two positions, each of said two positions being located on opposite sides of said longitudinal axis of said self-powered vehicle.

7. Cable laying apparatus as in claim 4 and further comprising a railcar for carrying cable to be buried by said plough, rail wheels on said railcar, a cable reel for holding, releasing and rewinding said cable and a power source for rotating said cable reel, said railcar being separate from said self-powered vehicle and being movable relative thereto.

8. Method of laying underground cable outside the rails of a railway comprising moving a cable plough mounted on a rubber tired self-powered vehicle positioned over railway track, said self-powered vehicle having a longitudinal axis, said self-powered vehicle moving on said rails with railwheels, said cable plough moving through ground located outside said railway track and laying said cable in said ground.

9. Method of laying underground cable as in claim 8 and further comprising raising and lowering at least two of said rail wheels relative to said rubber tired self-powered vehicle.

10. Method of laying underground cable as in claim 8 wherein said cable plough has a ground engaging shank, said cable plough being mounted in one of two positions, each of said two positions being located on opposite sides of said longitudinal axis of said self-powered vehicle, said ground engaging shank being operable to engage said ground outside said railway track in each of said two positions.

11. Method of laying underground cable as in claim 10 and further comprising raising and lowering at least two of said railwheels relative to said rubber tired self-powered vehicle.

12. Method of laying underground cable as in claim 10 and further comprising mounting a cable reel on a railcar and supplying cable from said cable reel to said cable plough, said railcar being separate from said self-powered vehicle and being moveable relative thereto.

13. Method of laying underground cable as in claim 12 and comprising providing power to said railcar with an engine mounted on said railcar.

* * * * *